US009889701B2

(12) United States Patent
Fukumoto et al.

(10) Patent No.: US 9,889,701 B2
(45) Date of Patent: Feb. 13, 2018

(54) WRITING IMPLEMENT

(71) Applicant: MITSUBISHI PENCIL COMPANY, LIMITED, Tokyo (JP)

(72) Inventors: Takeo Fukumoto, Yokohama (JP); Tooru Nakajima, Yokohama (JP); Kazuhiko Furukawa, Yokohama (JP)

(73) Assignee: MITSUBISHI PENCIL COMPANY, LIMITED, Tokyo (JP)

( * ) Notice: Subject to any disclaimer, the term of this patent is extended or adjusted under 35 U.S.C. 154(b) by 0 days.

(21) Appl. No.: 15/302,409

(22) PCT Filed: Apr. 9, 2015

(86) PCT No.: PCT/JP2015/061093
§ 371 (c)(1),
(2) Date: Oct. 6, 2016

(87) PCT Pub. No.: WO2015/156352
PCT Pub. Date: Oct. 15, 2015

(65) Prior Publication Data

US 2017/0028769 A1 Feb. 2, 2017

(30) Foreign Application Priority Data

Apr. 10, 2014 (JP) ..... 2014-080725
Apr. 10, 2014 (JP) ..... 2014-080726
Apr. 11, 2014 (JP) ..... 2014-081724

(51) Int. Cl.
*B43K 7/00* (2006.01)
*B43K 8/00* (2006.01)
*B43K 1/08* (2006.01)

(52) U.S. Cl.
CPC ..... *B43K 7/005* (2013.01); *B43K 1/08* (2013.01); *B43K 7/00* (2013.01); *B43K 8/00* (2013.01)

(58) Field of Classification Search
CPC combination set(s) only.
See application file for complete search history.

(56) References Cited

U.S. PATENT DOCUMENTS 6,340,262 B1 * 1/2002 Komiya ..... B43K 5/18 401/198
6,428,235 B1 8/2002 Takanashi et al.
(Continued)

FOREIGN PATENT DOCUMENTS

EP 1 470 931 A1 10/2004
JP 7-329484 A 11/2002
(Continued)

OTHER PUBLICATIONS

International Search Report (ISR) dated May 26, 2015, issued in International Application No. PCT/JP2015/061093 (2 pages).
(Continued)

*Primary Examiner* — David Walczak
(74) *Attorney, Agent, or Firm* — Westerman, Hattori, Daniels & Adrian, LLP

(57) ABSTRACT

A writing implement in which a joint connecting an ink supply section and a ballpoint pen tip together is configured from three members. The three members configuring the joint are a substantially cylindrical center member, a substantially cylindrical surrounding member formed at the outer periphery of the center member, and an interposing member that is molded by a soft member molded so as to cover the outer periphery of the center member and the surrounding member. An annular gap section is provided between the center member and the surrounding member. The leading end of the ink supply section is fitted into the gap section. The joint is formed by two color molding. The center member and the surrounding member are molded by primary molding, and the interposing member is integrally
(Continued)

molded onto the center member and the surrounding member by secondary molding.

4 Claims, 11 Drawing Sheets

(56) References Cited

U.S. PATENT DOCUMENTS

| | | | | |
|---|---|---|---|---|
| 6,582,144 | B1 * | 6/2003 | Matsumoto | B43K 5/18 401/209 |
| 2003/0072600 | A1 * | 4/2003 | Furukawa | B43K 5/005 401/224 |
| 2004/0161291 | A1 * | 8/2004 | Noguchi | A45D 34/042 401/224 |
| 2005/0074274 | A1 | 4/2005 | Furukawa et al. | |
| 2007/0201940 | A1 | 8/2007 | Ziniti et al. | |

FOREIGN PATENT DOCUMENTS

| | | | |
|---|---|---|---|
| JP | 2002-331789 | A | 11/2002 |
| JP | 2003-220784 | A | 8/2003 |
| JP | 2013-252655 | A | 12/2013 |
| WO | 2013/183744 | A1 | 12/2013 |

OTHER PUBLICATIONS

Extended Search Report dated Nov. 9, 2017, issued in counterpart European Application No. 15777299.7 (8 pages).

* cited by examiner

WRITING IMPLEMENT

TECHNICAL FIELD

The present invention relates to a writing implement that enables tilting of the writing tip.

BACKGROUND ART

Hitherto, in technology related to writing implements that enable tilting of the writing tip and improve the writing sensation, writing implements such as those described in Patent Document 1 are known in which an elastic body is interposed between a shaft body and a tip member, such that the writing tip is tilted by flexing of the elastic body according to the force during writing.

PRIOR ART DOCUMENTS

Patent Document 1: JP-A No. 2002-331789

SUMMARY OF INVENTION

Technical Problem

However, issues with the invention described in Patent Document 1 are that the amount of flexing of the writing tip is limited by the gap between the shaft body and the tip member, and that wobbling and changes in texture arise with degeneration of an elastic body, such as rubber or elastomer. Moreover, due to the elastic body being installed at the outer periphery of the shaft body, there is also an issue of the writer touching the elastic body and promoting deterioration of the elastic body.

Thus the present invention addresses the provision of a writing implement in which the amount of flexing in the pen tip can be changed according to the force applied during writing, deterioration of the elastic body suppressed, wobbling is less liable to occur, and a consistent writing sensation can be obtained.

Solution to Problem

First Aspect

In order to solve the above problems, a first aspect of the present application includes a writing tip, an ink supply section that supplies ink to the writing tip, a joint that connects the writing tip and the ink supply section together, and a shaft that internally houses the writing tip, the ink supply section, and the joint, wherein the joint includes a center member that is connected to at least the writing tip, a surrounding member that is separated from the center member, and an interposing member that is formed so as to connect the center member and the surrounding member, and wherein the interposing member is made of a different material from that of the center member and the surrounding member.

According to the type of ink, the writing implement may be a ballpoint pen or a marker pen by making the writing tip a ballpoint pen tip or a fiber bundle for use in a marker. The shaft may have ink directly housed inside, or may have a structure in which a refill filled with ink is housed inside the shaft. The ink supply section may supply the writing tip with ink housed inside the shaft using an intermediate member, such as a collector, or may supply the writing tip with ink housed in an ink housing tube, such as a refill, that is a separate body to the shaft.

The present aspect enables a soft writing sensation like that of a fountain pen to be obtained due to the joint flexing according to the force applied during writing.

Second Aspect

In addition to the features of the first aspect, in a second aspect of the present application the joint is molded by two color molding, the center member and the surrounding member are molded by primary molding, and the interposing member is integrally molded onto the center member and the surrounding member by secondary molding.

The two color molding referred to here is molding of a single molded item by molding two or more types of resin over two or more times of molding, and includes molding using the same type of resin.

The present aspect, similarly to the first aspect, enables a soft writing sensation like that of a fountain pen to be obtained due to the joint flexing according to the force applied during writing. Moreover, due to the integral molding, the center member and the surrounding member can be securely engaged by the interposing member.

Third Aspect

In addition to the features of the first aspect or the second aspect, in a third aspect of the present application the interposing member is molded from a softer material than that of the center member and the surrounding member.

The soft material referred to here is not limited as long as it is softer than the center member and the surrounding member; however, a thermoplastic elastomer is preferably employed in order to perform a molding process using a mold at a high temperature.

The present aspect, similarly to the first aspect, results in a softer writing sensation due to employing a soft material for the interposing member such that the joint flexes more according to the force applied during writing.

Fourth Aspect

In addition to the first, second, or third aspect, in the fourth aspect of the present application the center member of the joint has a substantially cylindrical shape, and the surrounding member of the joint is formed in a substantially cylindrical shape at an outer periphery of the center member, with a leading end of the ink supply section being inserted into an annular space formed between the center member and the surrounding member.

Advantageous Effects of Invention

Due to configuration as described above, the invention of the present application is able to make the joint flex according to the force applied during writing, and, accompanying such flexing, is able to make the writing tip flex so as to obtain a soft writing sensation like that of a fountain pen.

DESCRIPTION OF EMBODIMENTS

Explanation follows using a ballpoint pen 1 having a collector inside as an example of a writing implement 1 of an embodiment of the present invention, with reference to the drawings. Note that in the present invention, "front" with reference to a writing implement 1 and its configuring components means the tip side for cases in which a writing tip 40 serves as the tip of the writing implement 1, and "rear" is the opposite side thereto.

First Example

Overall Structure

Figure 1A:
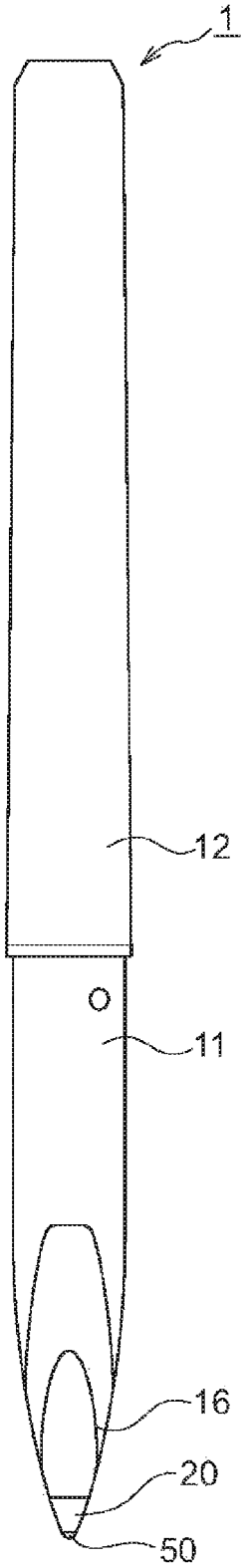
FIG. 1A is a face-on view of a ballpoint pen of a first example of the present invention.
Figure 1B:
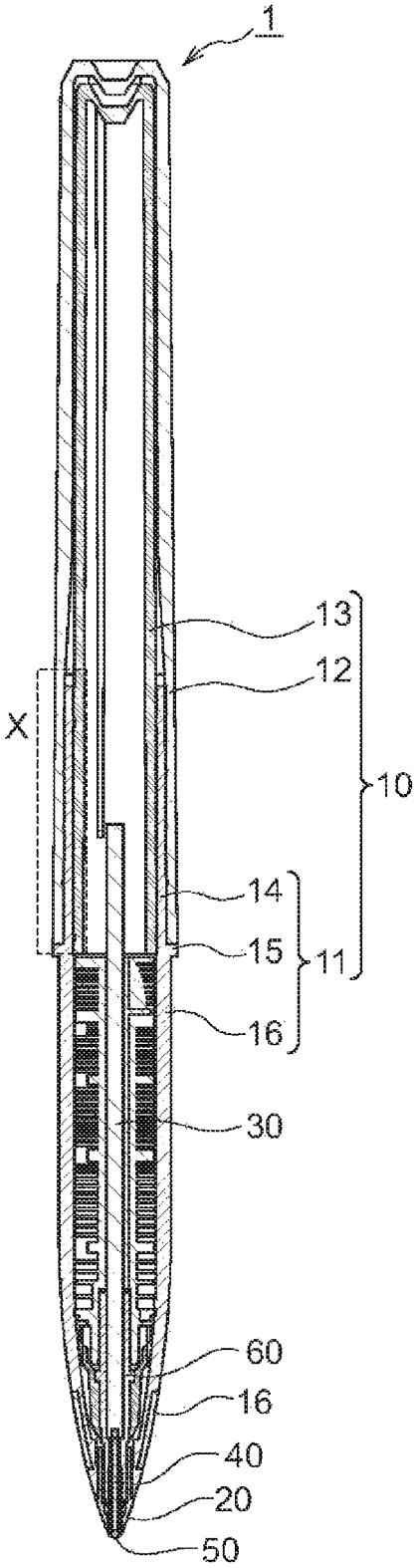
FIG. 1B is a vertical cross-section thereof.

As illustrated in FIG. 1A and FIG. 1B, the ballpoint pen 1 includes a ballpoint pen tip 40 with a writing ball 50 clasped at the leading end, an ink supply section 30 that supplies ink to the ballpoint pen tip 40, a joint 60 that connects the ballpoint pen tip 40 and the ink supply section 30 together, a shaft 10 internally housing the ballpoint pen tip 40, joint 60, and ink supply section 30, and an outer member 20 that is installed to the leading end of the shaft 10 and covers the outer periphery of the ballpoint pen tip 40.

Shaft Structure

As illustrated in FIG. 1B, the shaft 10 is configured from a ink tank 13 which is formed in a cylindrical shape and has a closed rear end, a tip shaft 11 which is formed in a cylindrical shape with a leading end having a tapered profile, and a rear shaft 12 which is formed in a cylindrical shape and has a closed rear end. A leading end of the ink tank 13 is fitted at the inner periphery of a rear end of the tip shaft 11. A rear end of the tip shaft 11 is fitted at the inner periphery of a leading end of the rear shaft 12.

Figure 2:
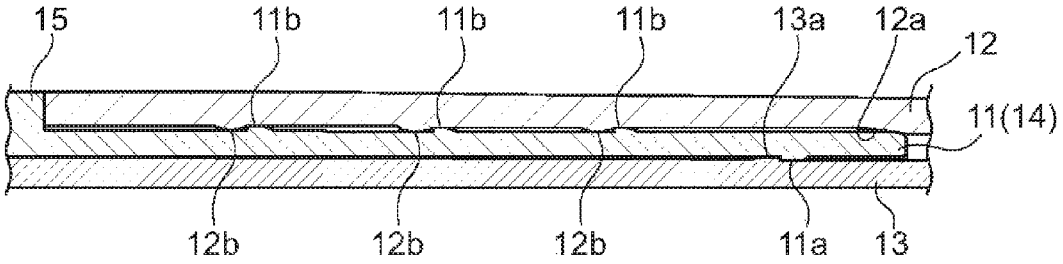
FIG. 2 is an enlargement of a fitting zone (X) of the shaft in FIG. 1B.

As illustrated in FIG. 1B, the outer diameter of the ink tank 13 is substantially the same diameter as the inner diameter of the rear end of the tip shaft 11. As illustrated in FIG. 2, at the outer periphery of the ink tank 13, an ink tank outer projection 13*a* which projects outwards at a location approximately ⅓ of the way along the ink tank 13 from the leading end is provided. The ink tank 13 is filled with non-illustrated ink.

Figure 3A:
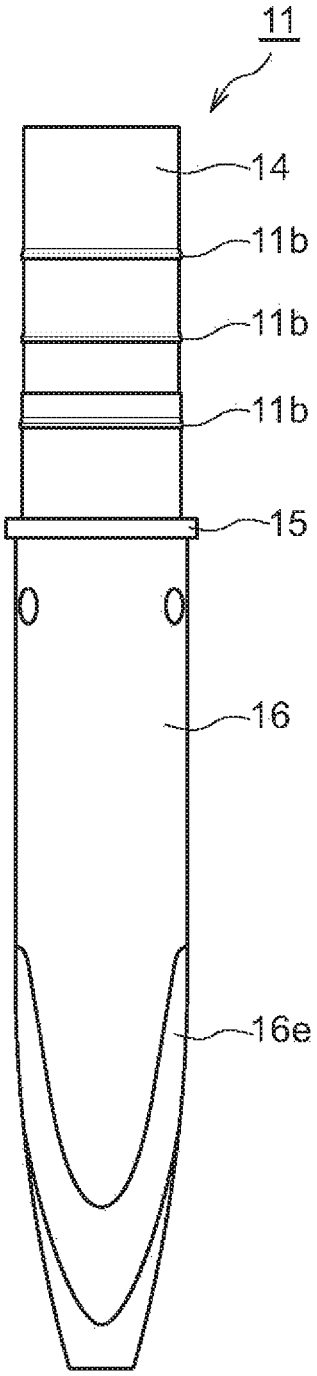
FIG. 3A is a face-on view of a tip shaft.
Figure 3B:
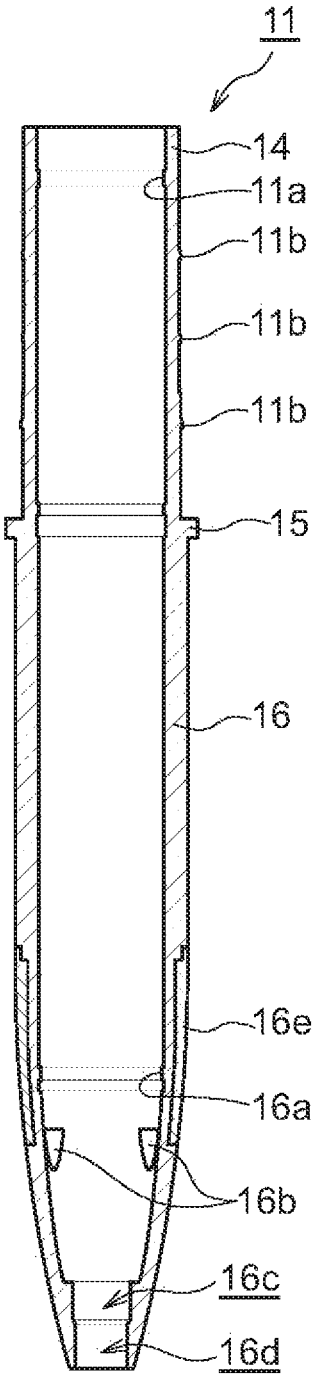
FIG. 3B is a vertical cross-section thereof.

As illustrated in FIG. 1B, the tip shaft 11 is substantially circular cylinder shaped with the leading end having a tapered profile. A tip shaft flange 15 is provided at a location on the outer periphery of the tip shaft 11 approximately ⅓ of the way along the tip shaft 11 from the rear end. The tip shaft flange 15 has an outer diameter which is substantially the same as the outer diameter of the rear shaft 12, and the leading end of the rear shaft 12 abuts the tip shaft flange 15. The tip shaft 11 is configured from a substantially cylindrical tube shaped tip shaft rear portion 14 at the rear, and a tip shaft front portion 16 having a tapered profile at the front, with the tip shaft flange 15 serving as a boundary therebetween. As illustrated in FIG. 2, a tip shaft inner projection 11*a* is provided on the inner periphery of the tip shaft rear portion 14 so as to project inward immediately to the rear of the ink tank outer projection 13*a* when the ink tank 13 has been fitted into the tip shaft 11. In front of the tip shaft inner projection 11*a*, there are plural tip shaft outer projections 11*b* provided on the outer periphery of the tip shaft rear portion 14 so as to project outward. As illustrated in FIG. 3B, at the inner periphery of the tip shaft front portion 16, a tip shaft front inner projection 16*a*, which is formed in a ring shape and engages with the ink supply section 30 at a location where the tapering starts, and thickened portions 16*b*, where a portion of the inner periphery of the tip shaft front portion 16 is thickened so as to make contact with the joint 60, are formed. Moreover, at the front of the tip shaft front portion 16, a tip shaft front reduced diameter hole 16*c*, having a reduced diameter so as to enable the leading end of the joint 60 to be inserted therein, and an outer insertion hole 16*d*, which is contiguously provided to the front of the tip shaft front reduced diameter hole 16*c* and has the outer member 20 inserted therein, are provided. A groove is provided on the outer periphery of the tip shaft front portion 16 in the vicinity of the leading end thereof, so as to enable mounting of another member, and a grip member 16*e* having an anti-slip action is mounted in the groove.

As illustrated in FIG. 1B, the inner diameter of the rear shaft 12 is substantially the same diameter as the outer diameter of the tip shaft rear portion 14. As illustrated in FIG. 2, at the inner periphery of the rear shaft 12, a rear shaft taper portion 12*a*, which is formed with a slightly reduced diameter at a position covering the rear end of the tip shaft 11 when the tip shaft 11 is fitted into the rear shaft 12, and rear shaft inner projections 12*b*, which project inward, are provided. The same number of rear shaft inner projections 12*b* are provided as the number of tip shaft outer projections 11*b*, with the rear shaft inner projections 12*b* each provided directly in front of the respective tip shaft outer projection 11*b* so as to be paired with the respective tip shaft outer projection 11*b*.

The above-described ink tank outer projection 13*a* and the tip shaft inner projection 11*a* engage with each other. The tip shaft outer projections 11*b* and the rear shaft inner projections 12*b* also engage with each other. Due to such engagement, the ink tank outer projection 13*a*, the tip shaft inner projection 11*a*, the tip shaft outer projections 11*b*, and the rear shaft inner projections 12*b* act as stoppers, such that the ink tank 13, the tip shaft 11, and the rear shaft 12 are not readily moved apart from each other. The ink tank outer projection 13*a* and the tip shaft inner projection 11*a* are each ridges formed with a ring profile. Moreover, the tip shaft outer projections 11*b* and the rear shaft inner projections 12*b* are, similarly, each ridges formed with a ring profile. A configuration may be adopted in which only one out of the ink tank outer projection 13*a* or the tip shaft inner projection 11*a* is formed as a ridge in a ring shape along the circumference. Moreover, a configuration may be adopted in which, similarly, only one out of the tip shaft outer projections 11*b* or the rear shaft inner projections 12*b* are each formed as a ridge in a ring shape along the circumference.

Ink Supply Section

Figure 4:
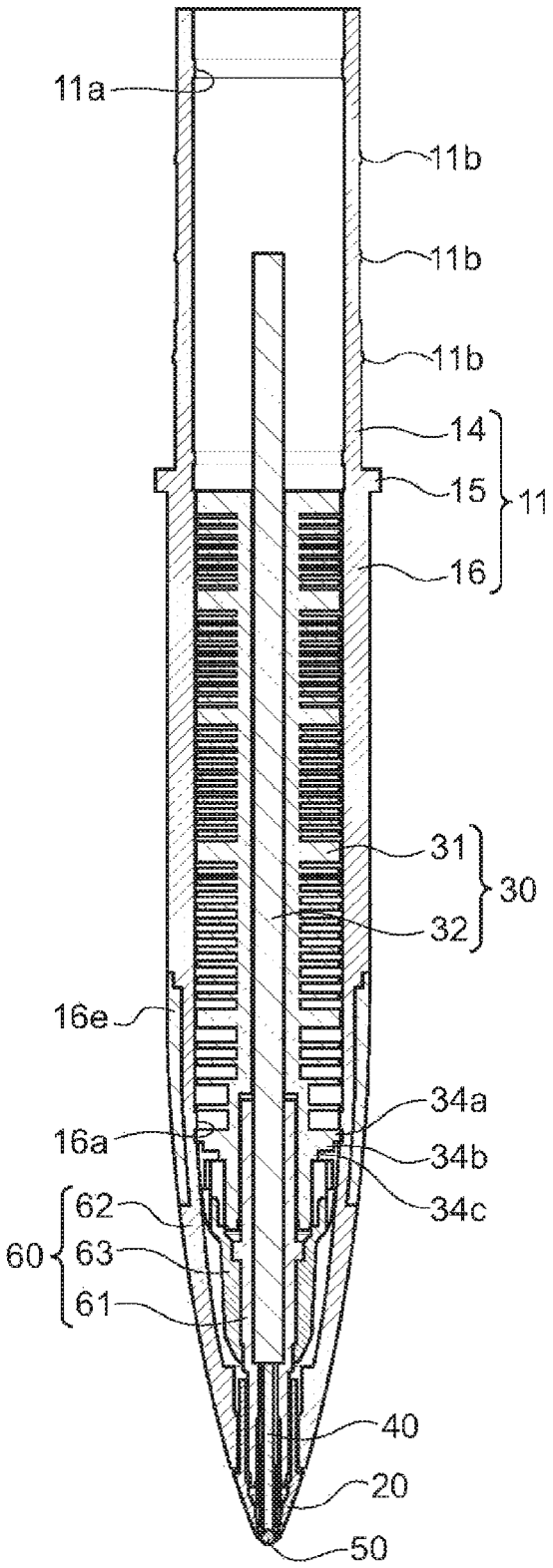
FIG. 4 is a vertical cross-section illustrating a state in which an ink supply section, a joint, and a ballpoint pen tip have been inserted into a tip shaft.
Figure 5:
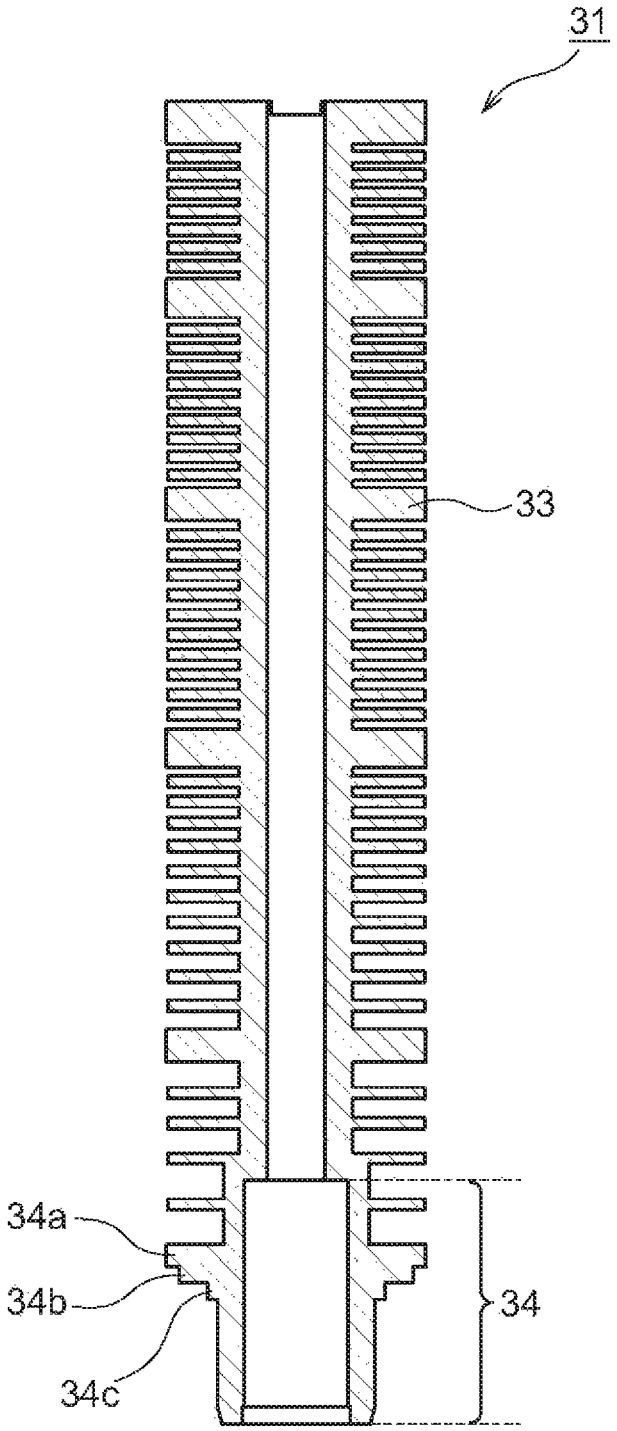
FIG. 5 is a vertical cross-section of a collector.

As illustrated in FIG. 4 and FIG. 5, the ink supply section 30 is configured from a collector 31 which is formed in a substantially tube shape and whose outer periphery is formed with plural comb shaped fins 33, and a collector core 32 which is made from polyester fiber formed into a rod shape and is inserted through the collector 31 along the axial direction, with the leading end of the collector core 32 fitted into the rear end of the joint 60. As illustrated in FIG. 5, a tip retainer 34 having an enlarged inner diameter is provided at the leading end of the collector 31.

As illustrated in FIG. 4 and FIG. 5, at the outer periphery of the tip retainer 34, a collector flange 34*a* which is formed in a ring shape immediately in front of the tip shaft front inner projection 16*a* to engage with the tip shaft front inner projection 16*a* formed to the inner periphery of the tip shaft front portion 16, a collector step 34*b* which is contiguously provided in front of the collector flange 34*a* with a smaller diameter than the collector flange 34*a*, and a collector contact portion 34*c* contiguously provided in front of the collector step 34*b* with a smaller diameter than the collector step 34*b*, are provided.

The rear end of the collector 31 contacts the ink tank 13. The rear of the collector core 32 projects inside the ink tank 13, and the front of the collector core 32 is inserted from the rear end of the joint 60 to a position approximately ½ the way along the joint 60.

Ballpoint Pen Tip

Figure 6:
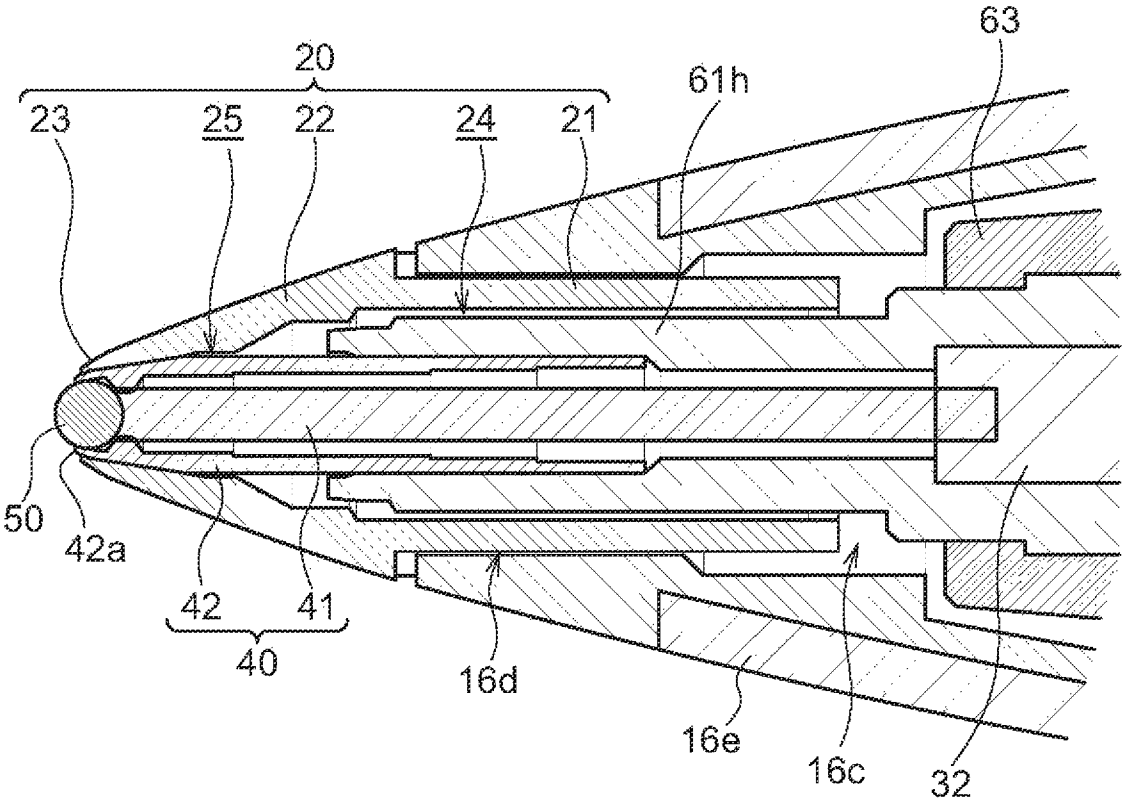
FIG. 6 is a vertical cross-section illustrating an enlargement of a tip end of the ballpoint pen.

As illustrated in FIG. 6, the ballpoint pen tip 40 is configured from a holder 42 which is formed in a circular cylinder shape, a center core 41 which is formed in a rod shape, projects out from the rear end of the holder 42 and is inserted into the holder 42, and the writing ball 50 held by the holder 42. A swaged section 42*a* is formed to the leading end of the holder 42 by pressing and deforming the tip end edge of the holder 42 inwards to give a reduced diameter. The leading end of the writing ball 50 is configured so as to be exposed through the leading edge of the swaged section 42*a*. The center core 41 is formed from polyester fiber similarly to the collector core 32. The rear end of the center core 41 fits together with the leading end of the collector core 32, and the leading end of the center core 41 reaches to immediately behind the writing ball 50, absorbs ink that has permeated into the collector core 32, and supplies the ink to the writing ball 50. Furthermore, the rear end of the ballpoint pen tip 40 to approximately ⅔ of the way along the ballpoint pen tip 40 is held by the joint 60.

The collector core 32 and the center core 41 are formed by appropriately selecting the porosity and surface profile of the polyester fiber according to characteristics, such as the viscosity, of the ink employed.

Joint

Figure 7C:
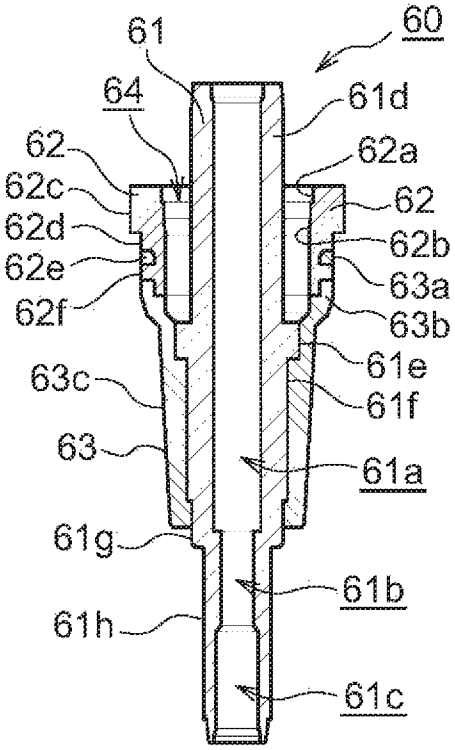
FIG. 7C is a vertical cross-section thereof.
Figure 7B:
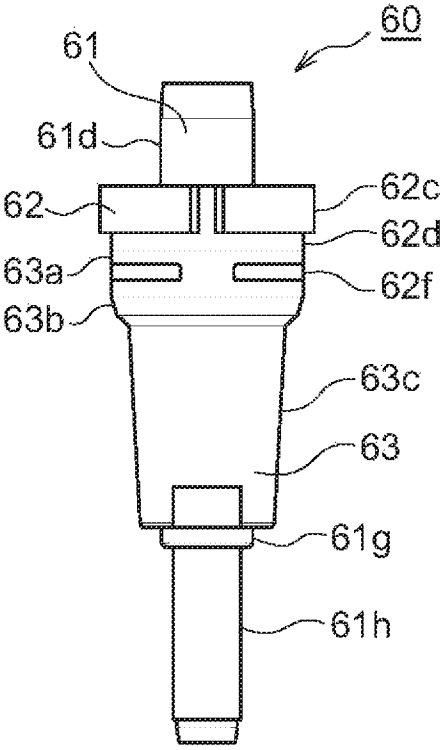
FIG. 7B is a face-on view thereof.
Figure 7A:
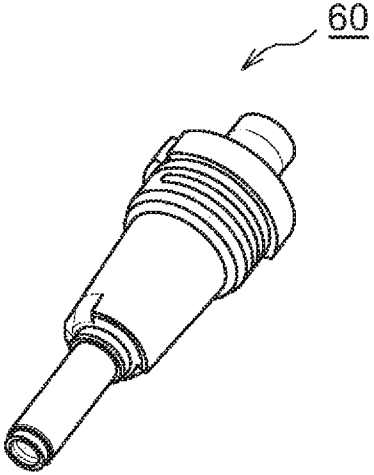
FIG. 7A is a perspective view of a joint.

As illustrated in FIG. 4 and FIG. 7, the joint 60 is configured from a center member 61 which is formed in a substantially cylindrical shape, a surrounding member 62 which is formed in a substantially cylindrical shape from approximately ¼ from the rear end of the center member 61 to approximately ⅓ from the rear end of the center member 61 such that a gap section 64 of the thickness of the tip retainer 34 of the collector 31 is present at the outer periphery of the rear of the center member 61, and an interposing member 63 which is formed so as to cover the center member 61 from the leading end of the surrounding member 62 to a Position Approximately ⅓ Back from the Leading End of the Center Member 61. The collector core 32 is inserted inside the center member 61 from the rear, and the ballpoint pen tip 40 is inserted inside the center member 61 from the front. The tip retainer 34 fits into the gap section 64 formed between the center member 61 and the surrounding member 62.

Figure 8C:
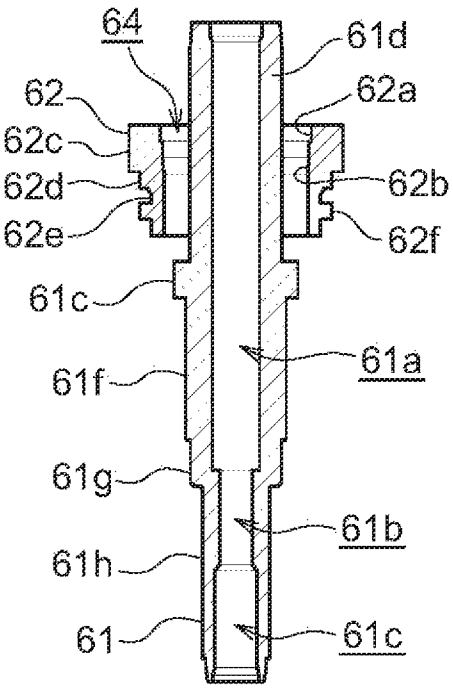
FIG. 8C is a vertical cross-section thereof.
Figure 8B:
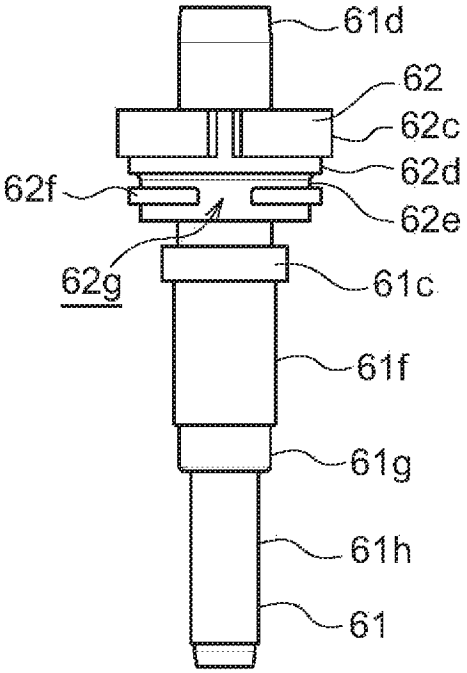
FIG. 8B is a face-on view thereof.
Figure 8A:
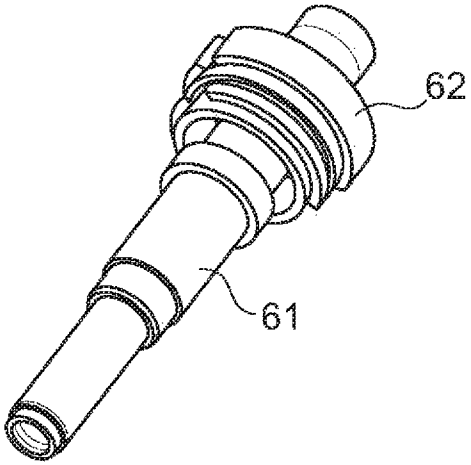
FIG. 8A is a perspective view of a primary molded body.

As illustrated in FIG. 8C, at the inner periphery of the center member 61, there are a rear insertion hole 61*a* of substantially the same diameter as the collector core 32 provided at the rear end, a center insertion hole 61*b* of substantially the same diameter as the center core 41 provided at a position from the vicinity of the rear end of the center core 41 to the rear end of the holder 42, and a front insertion hole 61*c* of substantially the same diameter as the holder 42 provided at a position from the rear end of the holder 42 to the leading end of the center member 61. At the outer periphery of the center member 61, there is a center member flange 61*e* which is formed in a ring shape further to the rear than ⅓ of the way back from the leading end of the rear insertion hole 61*a* of the center member 61. The center member flange 61*e* is formed at a position in front of the leading end of the peripheral member 62 and has a smaller diameter than the outer diameter of the tip retainer 34. The outer periphery of the center member 61 is configured from a rear circular columnar rear section 61*d* provided at a position from the rear end of the center member 61 up to the center member flange 61*e*, a rear circular columnar front section 61*f* provided at a position from the center member flange 61*e* further to the rear than the leading end of the rear insertion hole 61*a*, a central circular columnar section 61*g* provided at a position from the leading end of the rear circular columnar front section 61*f* to slightly to the front of the rear end of the center insertion hole 61*b*, and a front circular columnar section 61*h* provided at a position from the leading end of the central circular columnar section 61*g* to the leading end of the center member 61. The outer diameters of the rear circular columnar rear section 61*d* and the rear circular columnar front section 61*f* are substantially the same diameter as the inner diameter of the tip retainer 34, the outer diameter of the central circular columnar section 61*g* is substantially the same diameter as the diameter of the tip shaft front reduced diameter hole 16*c*, and the outer diameter of the front circular columnar section 61*h* is substantially the same diameter as the diameter of a rear insertion hole 24 provided in the rear of the outer member 20.

As illustrated in FIG. 8C, the inner diameter of the surrounding member 62 is substantially the same diameter as the outer diameter of the tip retainer 34 of the collector 31. On the inner periphery of the surrounding member 62, a surrounding member wide diameter portion 62*a* with a slightly wider diameter located at a position at the rear end of the surrounding member 62, and a surrounding member inner projection 62*b* formed in a ring shape located at a position approximately ½ the way along the surrounding member 62 from the rear end of the surrounding member 62, are provided. The diameter of the surrounding member wide diameter portion 62*a* is set smaller than the diameter of the collector contact portion 34*c* so as to facilitate insertion of the tip retainer 34 therein. The surrounding member inner projection 62*b* is provided to clamp the tip retainer 34 of the ink supply section 30, using the surrounding member 62 and the center member 61. The outer periphery of the surrounding member 62 is configured from a surrounding member rear outer peripheral portion 62*c* at positions from the rear end of the surrounding member 62 to the surrounding member inner projection 62*b*, a surrounding member central outer peripheral portion 62*d* contiguous to the surrounding member rear outer peripheral portion 62*c*, and a surrounding member front outer peripheral portion 62*e* contiguous to the surrounding member central outer peripheral portion 62*d* to a position as far as the leading end of the surrounding member 62. The diameter of the surrounding member rear outer peripheral portion 62*c* is substantially the same diameter as the collector step 34*b*, the diameter of the surrounding member central outer peripheral portion 62*d* is slightly smaller than the diameter of the surrounding member rear outer peripheral portion 62*c*, and the diameter of the surrounding member front outer peripheral portion 62*e* is slightly smaller than the diameter of the surrounding member central outer peripheral portion 62*d*. A ring shaped surrounding member outer projection 62*f* is provided from the leading end of the surrounding member front outer peripheral portion 62*e* to a position about ½ way along the surrounding member front outer peripheral portion 62*e*. A cutout 62*g* is provided to the surrounding member outer projection 62*f* at at least one location in the circumferential direction. The outer diameter of the cutout 62*g* is the same as the outer diameter of the surrounding member front outer peripheral portion 62*e*.

Figure 9C:
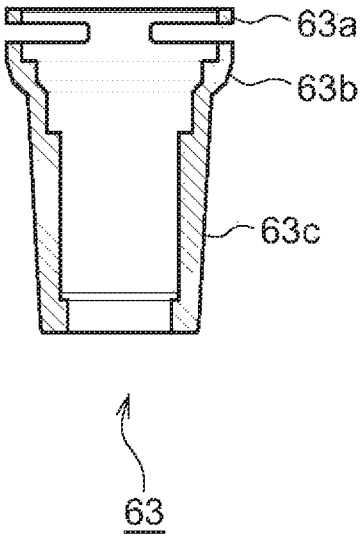
FIG. 9C is a vertical cross-section thereof.
Figure 9B:
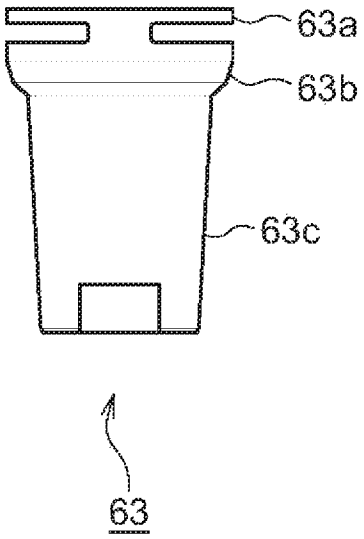
FIG. 9B is a face-on view thereof.
Figure 9A:
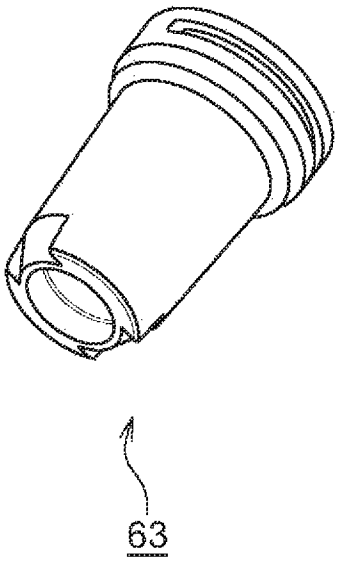
FIG. 9A is a perspective view of a secondary molded body.

As illustrated in FIG. 7 and FIG. 9C, the interposing member 63 is configured from a interposing member rear circular columnar section 63*a* of substantially circular cylinder shape covering the peripheral member 62 and having substantially the same outer diameter as the diameter of the peripheral member outer projection 62*f*, a coupling section 63*b* which is contiguously provided to the interposing member rear circular columnar section 63*a* and is formed in a substantially circular conical shape covering as far as the center member flange 61*e*, and an interposing member front conical section 63*c* which is contiguously provided to the coupling section 63*b* and is formed in a gently-sloping circular conical shape covering as far as the vicinity of the center of the central circular columnar section 61*g*. The interposing member rear circular columnar section 63*a* covers from the rear end of the surrounding member front outer peripheral portion 62*e*, across the cutout 62*g* of the surrounding member 62, as far as the leading end of the surrounding member front outer peripheral portion 62*e*, and, as a result, engages with the surrounding member outer projection 62*f*. The inner periphery of the interposing member 63 is formed so as to follow along the outer periphery of the center member 61 and the surrounding member 62, has an inner diameter at the position of the rear end of the coupling section 63*b* that is the same as the inner diameter of the surrounding member 62, and has a taper such that an inner diameter at the position in front of the coupling section 63*b* gradually decreases from the inner diameter of the interposing member 63 to the outer diameter of the center member flange 61*e*.

Two Color Molding

The joint 60 is a component molded by two color molding, the center member 61 and the surrounding member 62 are molded by primary molding, and the interposing member 63 is integrally molded onto the center member 61 and the surrounding member 62 by secondary molding. In order to obtain flexing, the interposing member 63 is formed from an elastic resin material at the coupling section 63*b*. A thermoplastic elastomer is preferably employed as the elastic material in order to perform a molding process using a mold at high temperature. The material of the center member 61 and the surrounding member 62 configuring the primary molded body is preferably a hard resin, such as a polyacetal resin.

Outer Member

As illustrated in FIG. 6, the outer member 20 is configured from an outer member fixing portion 21 which is formed in a circular cylinder shape, and an outer member taper portion 22 which is contiguously provided to the outer member fixing portion 21 and has a substantially circular conical shaped profile. A beveled outer member tip portion 23 is provided at the leading end of the outer member taper portion 22. A hole is formed through from the rear end toward the leading end of the outer member 20. A rear insertion hole 24 is provided at the inner face of the outer member fixing portion 21, and a front insertion hole 25 of smaller diameter than the rear insertion hole 24 is provided at the inner face in the vicinity of the leading end of the outer member taper portion 22. The outer member fixing portion 21 is fixed to the tip shaft 11 by fitting into the outer member insertion hole 16*d*. The outer member 20 covers the ballpoint pen tip 40. Then, the front circular columnar section 61*h* of the joint 60 is inserted into the rear insertion hole 24, and the ballpoint pen tip 40 projecting out from the joint 60 is inserted into the front insertion hole 25. As illustrated in FIG. 6, the writing ball 50 and the swaged section 42*a* covering the writing ball 50 are exposed from the outer member tip portion 23.

Ballpoint Pen Characteristics

In the ballpoint pen 1, the joint 60 is formed from 3 members, and although the surrounding member 62 and the center member 61 are formed by the same primary molded body, they are not connected to each other as the primary molded body. Deformation accordingly occurs in the vicinity of the coupling section 63*b* of the interposing member 63, giving a structure in which the joint 60 readily flexes.

Ballpoint Pen Assembly

The ballpoint pen 1 is assembled in the following manner. First the tip retainer 34 of the collector 31 is inserted into the gap section 64 of the joint 60, the collector core 32 is then inserted from the rear end of the collector 31 and the ballpoint pen tip 40 clasping the writing ball 50 is inserted from the leading end of the joint 60, fitting the center core 41 of the ballpoint pen tip 40 together with the collector core 32. The assembled collector 31, collector core 32, joint 60, and ballpoint pen tip 40 are then inserted from the rear end of the tip shaft 11. Then the outer member 20 is installed at the inner periphery of the tip shaft 11 so as to cover the ballpoint pen tip 40. Or assembly may be performed by, after installing the outer member 20 at the inner periphery of the tip shaft 11, inserting the assembled collector 31, collector core 32, joint 60, and ballpoint pen tip 40 from the rear end of the tip shaft 11.

Next, the rear end of the tip shaft 11 is fitted over the outer periphery of the ink tank 13 filled with ink until the leading end of the ink tank 13 contacts the rear end of the collector 31.

Finally, the rear end of the tip shaft 11 is inserted at the inner periphery of the leading end of the rear shaft 12 so as to cover the ink tank 13. When inserting the tip shaft 11 into the rear shaft 12, insertion is performed until the leading end of the rear shaft 12 contacts the tip shaft flange 15.

Then, positioning is performed on the ballpoint pen tip 40 and the ink supply section 30 by the tip shaft front inner projection 16*a* provided at the inner periphery of the tip shaft 11 and by the collector flange 34*a* of the collector 31. There is accordingly a need to insert the joint 60 and the ballpoint pen tip 40 through from the tip shaft front inner projection 16*a* as far as the outer tip portion 23. Then, due to the interposing member 63 of the joint 60 being an elastic member, even if there were to be a difference in dimension in the vertical direction of the tip retainer 34 and the outer fixing portion 21, housing in the outer tip portion 23 through from the tip shaft front inner projection 16*a* can be achieved by contraction of the elastic member.

Fitting Method of the Tip Shaft, the Rear Shaft and the Ink Tank

The method of fixing the ink tank 13 and the tip shaft 11 is by, when inserted such that the leading end of the ink tank 13 contacts the rear end of the collector 31, positioning the ink tank outer projection 13*a* immediately in front of the tip shaft inner projection 11*a* such that each of the projections acts as a stopper.

When the ink tank 13 has been inserted into the tip shaft 11, a gap develops between the inner peripheral face at the rear end of the tip shaft 11, and the outer peripheral face at the leading end of the ink tank 13, depending on the height of the tip shaft inner projection 11*a*.

Note that there are no particular limitations to the method of fixing the rear shaft 12 and the ink tank 13. For example, a method may be adopted in which the inner diameter of the rear shaft 12 is formed so as to be smaller at the rear end than the outer diameter of the ink tank 13, and the ink tank 13 is press-fixed to the rear shaft 12, or a method may be adopted in which the ink tank outer projection 13*a* and the rear shaft inner projections 12*b* are provided to engage, with one of the projections riding over the other projection, such that each of the projections acts as a stopper.

Then, when the rear shaft 12 covers the tip shaft 11, the rear shaft inner projections 12*b* are positioned immediately in front of the tip shaft outer projections 11*b*, each of the projections acts as a stopper, and, at the same time, the rear end of the tip shaft 11 is compressed inwards by the rear shaft taper portion 12*a*, the tip shaft inner projection 11*a* acts as a pivot point and gaps are compressed, and the rear end of the tip shaft 11 is pressed against the ink tank 13, such that the rear shaft 12 and the tip shaft 11 are fixed.

As a result, the rear end of the tip shaft 11 is pressed against the outer peripheral face of the ink tank 13, and in addition the tip shaft inner projection 11*a* and the ink tank outer projection 13*a*, and the tip shaft outer projections 11*b* and the rear shaft inner projections 12*b*, act as stoppers, enabling strong fixing to be achieved.

Moreover, due to a reaction to the rear end of the tip shaft 11 being pressed by the rear shaft taper portion 12*a* with the tip shaft inner projection 11*a* acting as a pivot point, positions at the front side of the tip shaft inner projection 11*a* are pressed toward the outside, raising the stopper action of the tip shaft outer projections 11*b* and the rear shaft inner projections 12*b*, and enabling stronger fixing to be achieved.

Second Example

Figure 10A:
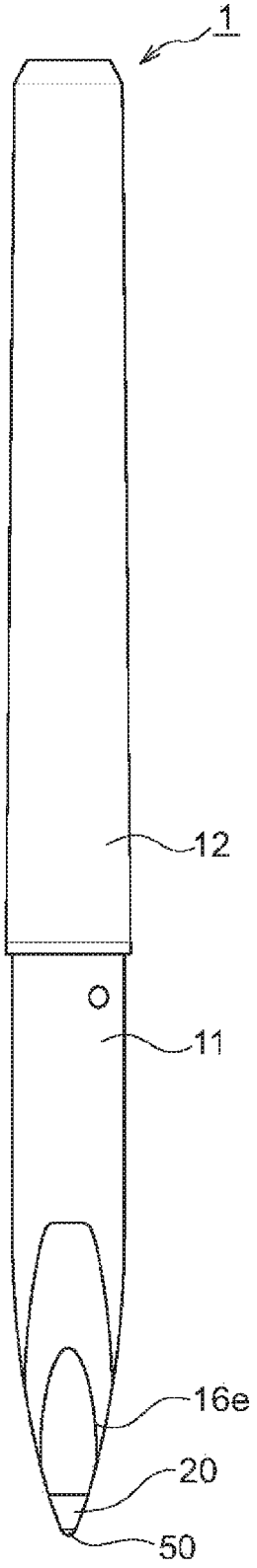
FIG. 10A is a face-on view of a ballpoint pen according to a second example and FIG. 10B is a vertical cross-section thereof.
Figure 10B:
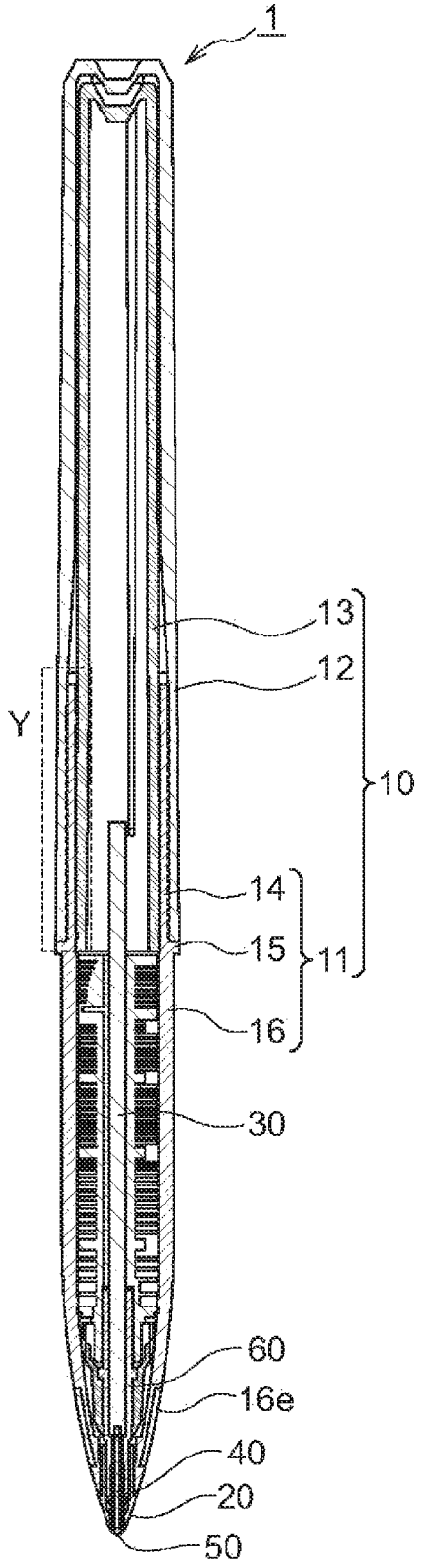
Figure 11:
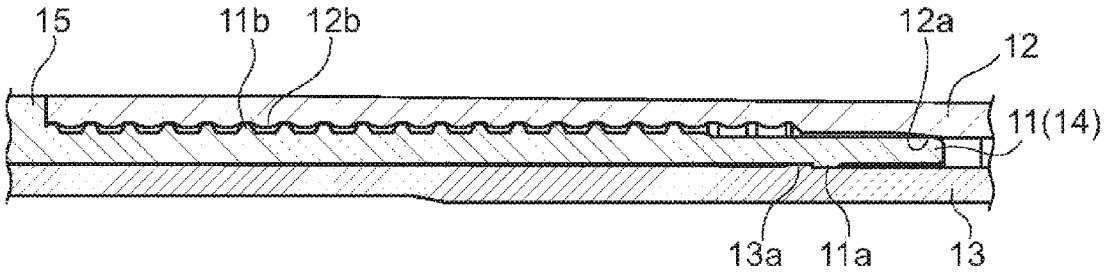
FIG. 11 is an enlargement of a fitting zone (Y) of the shaft in FIG. 10B.

Explanation follows regarding a second example according to an embodiment of the present invention, with reference to FIG. 10 and to FIG. 11. Note that the FIG. 5 to FIG. 9 of the first example are common to the second example. Moreover, configuration elements in the second example similar to those of the first example are allocated the same reference numerals as the reference numerals employed in the first example. Explanation is omitted of parts duplicating those of the first example, with explanation focusing on the features of the second example.

The second example is an embodiment in which the tip shaft outer projections 11*b* exhibit a screw thread profile, and fixing is by screwing the tip shaft outer projections 11*b* together with the rear shaft inner projections 12*b*.

Overall Structure

As illustrated in FIG. 10A and FIG. 10B, a ballpoint pen 1 includes a ballpoint pen tip 40 with a writing ball 50 clasped at the leading end, an ink supply section 30 that supplies ink to the ballpoint pen tip 40, a joint 60 that connects the ballpoint pen tip 40 and the ink supply section 30 together, a shaft 10 internally housing the ballpoint pen tip 40, joint 60, and ink supply section 30, and an outer member 20 that is installed to the leading end of the shaft 10 and covers the outer periphery of the ballpoint pen tip 40.

Tip Shaft Structure

As illustrated in FIG. 11, a tip shaft 11 of the second example features tip shaft outer projections 11*b* exhibiting a screw thread profile formed along the outer peripheral face of a tip shaft rear portion 14. Note that the configuration of other parts of the tip shaft 11 is common to that of the first example, and so explanation thereof is omitted.

Fitting Method of the Tip Shaft, the Rear Shaft and the Ink Tank

The method of fixing the ink tank 13 and the tip shaft 11 together is common to that of the first example, and so explanation thereof is omitted.

The method of fixing the rear shaft 12 and the ink tank 13 together is common to that of the first example, and so explanation thereof is omitted.

Then, the tip shaft 11 is inserted into the rear shaft 12 so that the tip shaft outer projections 11*b* are screwed together with the rear shaft inner projections 12*b*, and, at the same time, the rear end of the tip shaft 11 is compressed inward by the rear shaft taper portion 12*a*, the tip shaft inner projection 11*a* acts as a pivot point and a gap is compressed, and the rear end of the tip shaft 11 is pressed against the ink tank 13, such that the rear shaft 12 and the tip shaft 11 are fixed.

This invention may be employed as a writing implement, such as a ballpoint pen or a marker pen.

The invention claimed is:

1. A writing implement comprising:

a writing tip;

an ink supply section that supplies ink to the writing tip;

a joint that connects the writing tip and the ink supply section together; and a shaft that internally houses the writing tip, the ink supply section, and the joint, the joint including:

a center member that is connected to at least the writing tip, a surrounding member that is separated from the center member, and an interposing member that is formed so as to connect the center member and the surrounding member together, and the interposing member being made of a different material from that of the center member and the surrounding member.

2. The writing implement of claim 1, wherein the joint is molded by two color molding, the center member and the surrounding member are molded by primary molding, and the interposing member is integrally molded onto the center member and the surrounding member by secondary molding.

3. The writing implement of claim 2, wherein the interposing member is molded from a softer material than that of the center member and the surrounding member.

4. The writing implement of claim 3, wherein:

the center member of the joint has a substantially cylindrical shape, and the surrounding member of the joint is formed in a substantially cylindrical shape at an outer periphery of the center member; and a leading end of the ink supply section is inserted into an annular space formed between the center member and the surrounding member.

* * * * *